US005950815A

United States Patent [19]

Yetman-Bellows

[11] Patent Number: 5,950,815

[45] Date of Patent: Sep. 14, 1999

[54] UNIVERSAL FRAME FOR MOUNTING EARRINGS AND OTHER JEWELRY

[76] Inventor: Helen Agnes Yetman-Bellows, 160 South Rd., Pepperell, Mass. 01463

[21] Appl. No.: 09/200,675

[22] Filed: Nov. 25, 1998

[51] Int. Cl.[6] ..... A45C 11/04

[52] U.S. Cl. ..... 206/6.1; 211/85.2

[58] Field of Search ..... 206/6.1, 495, 566; 211/85.2, 113

[56] References Cited

U.S. PATENT DOCUMENTS 4,687,103 8/1987 Corbett .
4,905,821 3/1990 Corbett .
4,923,069 5/1990 Germain et al. .
5,050,745 9/1991 Sanders .
5,390,800 2/1995 Tucker .
5,551,772 9/1996 Keffer ..... 206/6.1
5,671,849 9/1997 Bacon ..... 206/6.1

*Primary Examiner*—David T. Fidei
*Attorney, Agent, or Firm*—Henry S. Miller

[57] ABSTRACT

A universal holder for post and open hook jewelry, including close loop jewelry that is capable of standing, hanging and stacking by means of appropriately space plane surfaces. A soft plastic mesh supported by a frame with hinged and locking legs and a key hole aperture providing two modes of support. Extensions from the frame are dimensionally correct so they lie flat one upon another.

10 Claims, 7 Drawing Sheets

UNIVERSAL FRAME FOR MOUNTING EARRINGS AND OTHER JEWELRY

BACKGROUND OF THE INVENTION

1. Field of the Invention

This invention relates generally to devices for storing and displaying earrings and other jewelry and in particular to such a device that will stand, hang and stack without disturbing the jewelry mounted thereon.

2. The Problem and Related Prior Art

It has become increasingly popular both males and females to have pierced ear lobes and other body parts. Concomitant with the body piercing comes the need to decorate the event with a piece of decorative jewelry. For example, the ear supports a common earring or post, the naval uses a ring while the nose uses either a post or ring. The tongue generally calls for a post while the eyebrow a ring. Since most of these body decorations are worn with pride and collected by the wearer in recognition of significant events, it is important that they not become lost, broken or damaged when not being used. This becomes a particular problem when many items have been collected and each is of significant importance to the owner.

There have been a number of jewelry display and storage devices suggested in the prior art. However, there is no showing of a single jewelry display or storage device that is capable of standing, hanging and lying completely flat for stacked storage. Examples of prior art devices that attempt to solve the problem are shown in U.S. Patents discovered in the records of the United States Patent and Trademark Office for example: U.S. Pat. No. 4,687,103 issued Aug. 18, 1987 to Corbett for a jewelry stand; U.S. Pat. No. 4,905,821 issued Mar. 6, 1990 to Corbett for another jewelry stand; U.S. Pat. No. 4,923,069 issued May 8, 1990 to Germain et al. for still another form of jewelry display device; U.S. Pat. No. 5,050,745 issued Sep. 24, 1991 to Sanders for a hanging earring storage holder, and U.S. Pat. No. 5,390,800 issued Feb. 21, 1995 to Tucker for another form of jewelry stand.

The instant invention as disclosed and claimed herein provides distinct and useful advantages not previously known to the prior art.

SUMMARY OF THE INVENTION

The invention is characterized by a quadrilateral frame forming an opening. A plastic mesh for supporting post or open hook jewelry and the like is fixed along the interior edges of the frameand occupies the opening. The frame is supported in a standing position by a pair of legs which are attached to opposed side members, on the rear face of the frame, with vertical hinges. In the standing mode the legs are held in an extended position by small wafer like members attached to the leg and rotatable into a slot located in the frame. When used in another mode the legs are unlocked and fold toward the centerline of the frame where they rest against the rear face. Along the top rear face is a calibrated block including a key hole shaped aperture to allow the frame to be hung from a vertical surface. The exposed face of the folded legs and the block all lie in the same plane whereby the frame will lie perfectly flat on a corresponding flat surface. The front face of the frame contains a plurality of mushroom shaped posts extending outwardly for mounting jewelry that cannot be mounted on the mesh area. The outwardly extending face of each post is likewise calibrated to lie in the same plane as the block and folded legs when a frame is stacked on top of another similar frame, thereby insuring stability when storing or transporting two or more frames.

It is therefore an object of the invention to provide a new and improve frame for storing or transporting earrings and other jewelry.

It is another object of the invention to provide a new and improved jewelry storage and display system that is highly stable in a standing mode.

It is a further object of the invention to provide a new and improved jewelry storage and display system that is highly stable in a hanging mode.

It is still another object of the invention to provide a new and improved jewelry storage and display system that is highly stable in the stacked mode of two or more similar frames.

It is still a further object of the invention to provide a new and improved jewelry storage and display system which allows for ease of inventory control for commercial vendors.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will be apparent when consideration is given to the following detailed description thereof. Such description makes reference to the annexed drawings wherein.

DETAILED DESCRIPTION OF A PREFERRED EMBODIMENT

Figure 1:
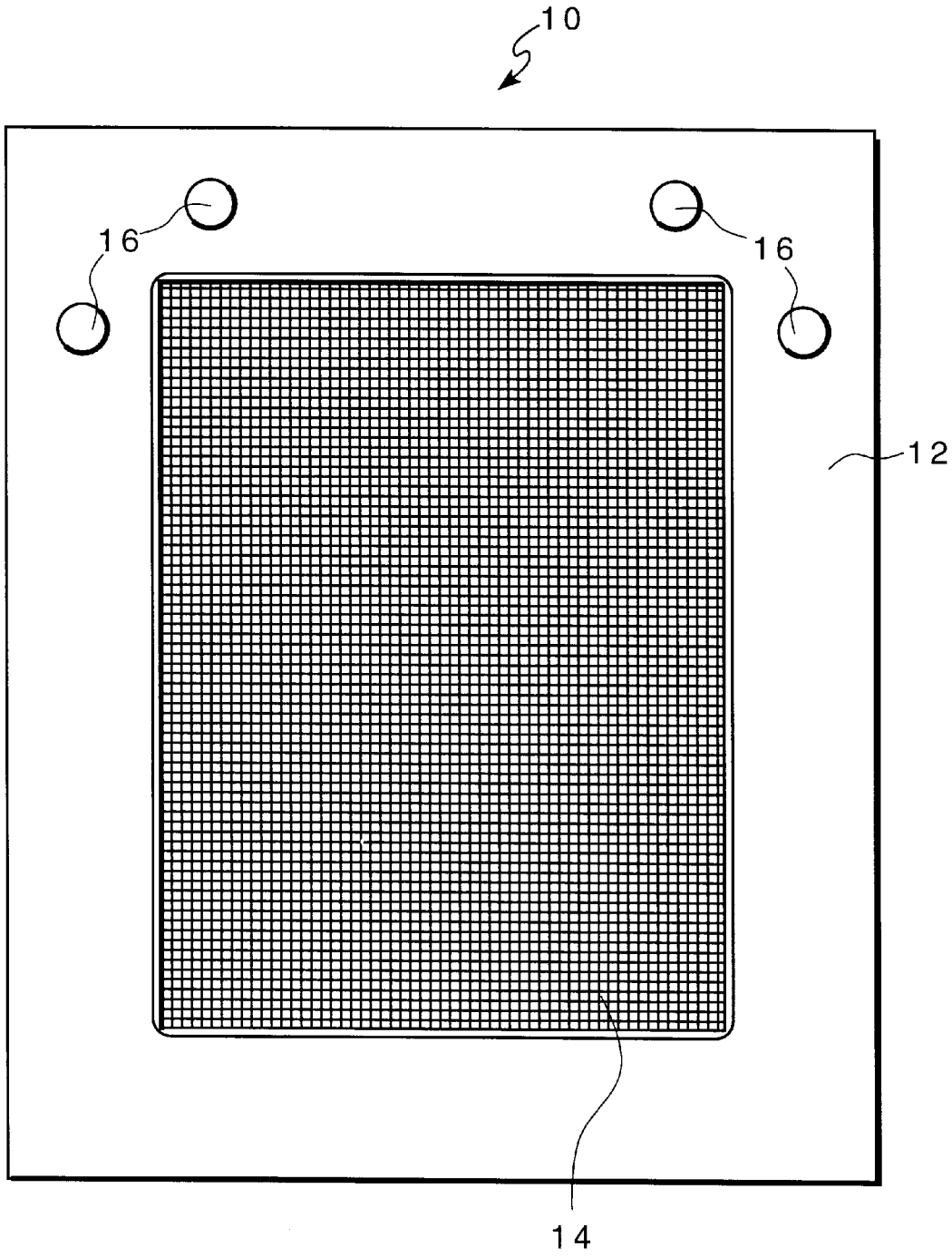
FIG. 1 is a front plan view of the invention.

Referring now to FIG. 1, the invention is generally shown at 10 and characterized by a frame 12, formed of wood or other suitable material. Within the area outlined by the frame is a soft plastic mesh 14 containing a pattern of apertures, each having sides of approximately ⅛ inch in length. Mushroom shaped posts or dowels 16 extend from the front of the frame and are adapted to receive larger closed loop jewelry, such as necklaces or bracelets. Although two posts are shown, the number is arbitrary, depending upon the size of the frame.

Figure 2:
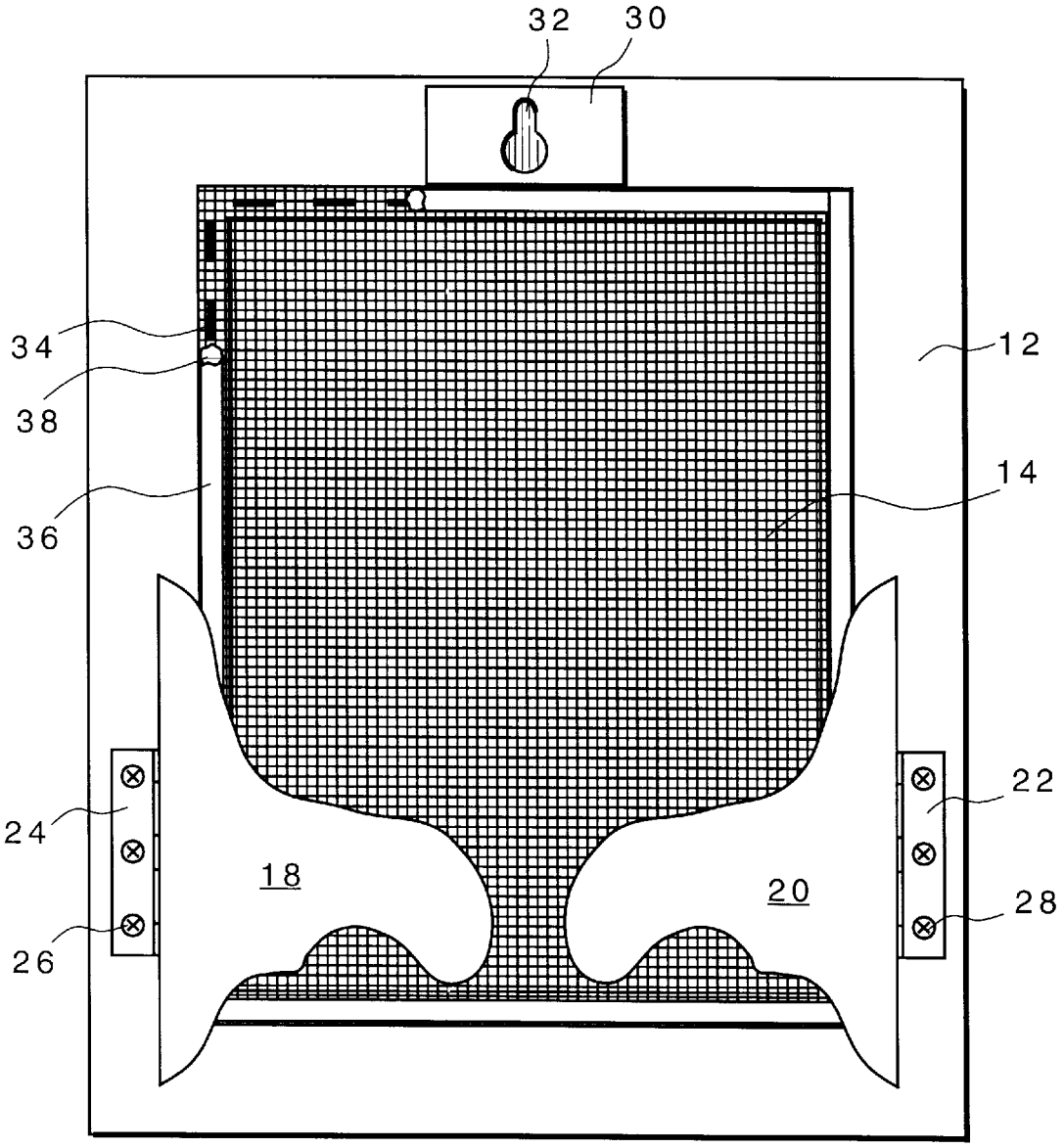
FIG. 2 is a rear plan view of the invention, with supporting legs folded inward.

Concerning FIG. 2, the rear side of the frame is shown at 12 and the mesh at 14. A pair of legs 18,20 are connected to the frame by hinges 22,24 which are secured to the frame by screw fasteners 26,28. Inward travel of the legs is limited by frame 12, thus preventing the legs from coming in contact and possibly damaging mesh 14. A block 30 is affixed to the top frame member and contains an inverted keyhole shaped aperture for receiving a fastener and allowing the frame to be hung from a vertical surface. The exposed superior surface of block 30 and legs 18 and 20, in the inward position all lie in the same plane, thereby enhancing the stacking feature of the invention. Mesh 14 is held to a recessed lip in the frame by staples 34. The staples are hidden from view by a decorative molding 36 such as for example, a product referred to as paper twist. The molding is secured in place by a hot gluing process 38.

Figure 3:
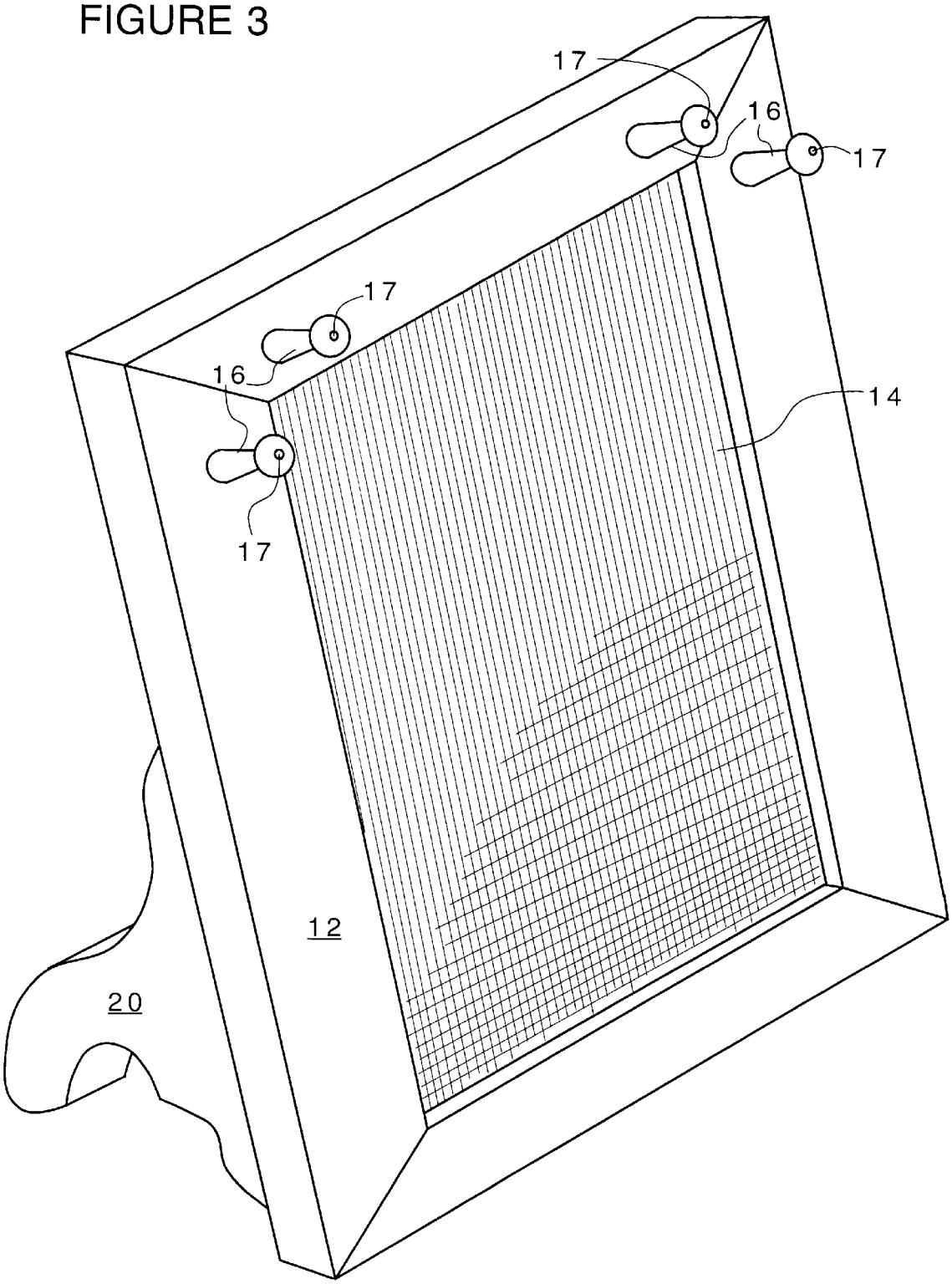
FIG. 3 is a front perspective view of the invention, in the standing mode.

FIG. 3 shows mushroom shaped dowel posts 16 which are fitted into an appropriate sized aperture and glued in place. The top surface of each post shown at 17 is exactly the same distance from the frame as the top surface of the block 30 and the folded legs 18 and 20. Thus when the frames are stacked one upon another the package is extremely stable.

Figure 4:
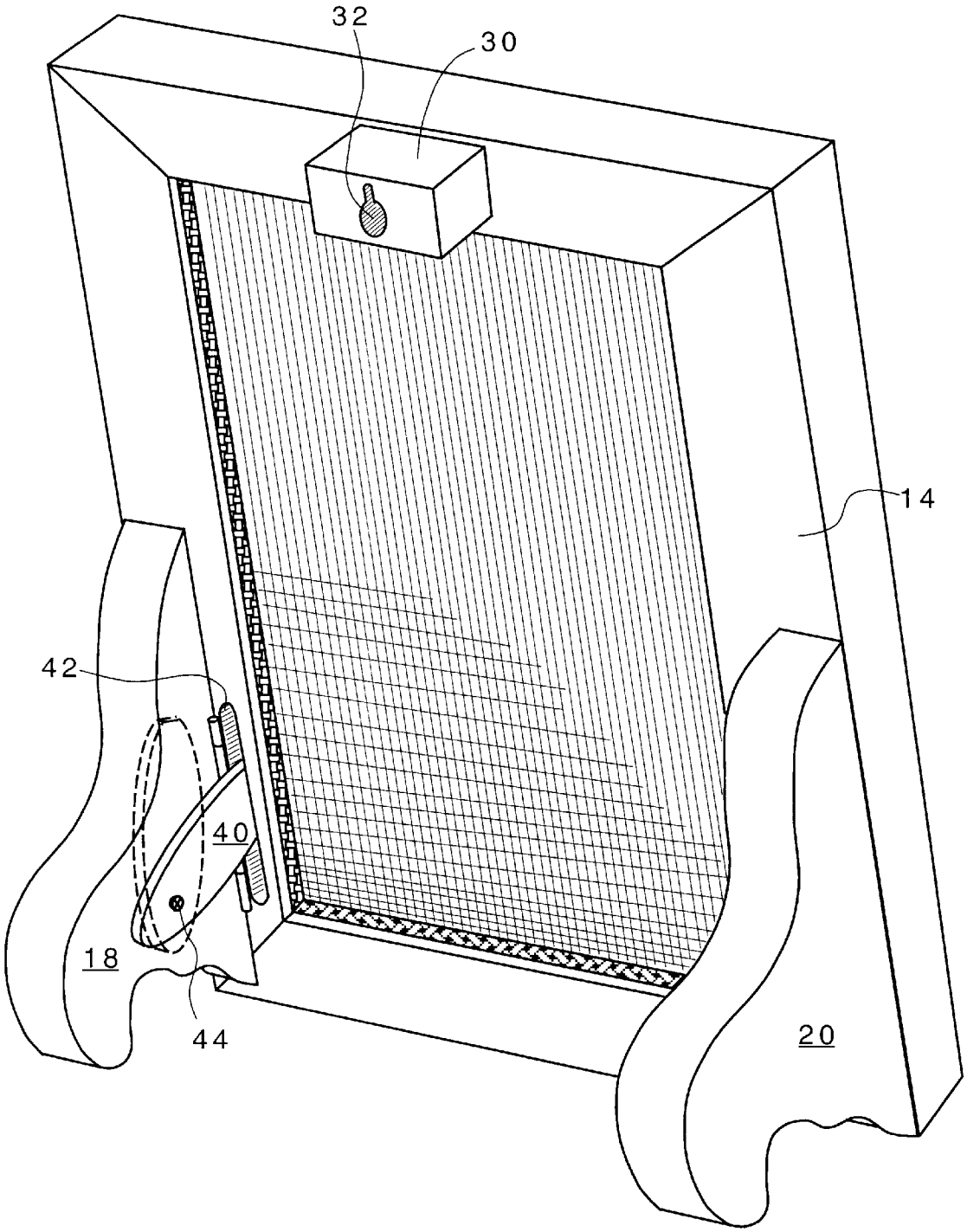
FIG. 4 is a rear perspective view of the invention, in the standing mode.

FIG. 4 shows the legs extended and locked in position by tile small elliptical and rotatable locking member 40 engaging a slot 42 in frame 12. Fastener 44 keeps the locking member in a friction fit with the leg 18. The locking set up for leg 20 is the same as leg 18.

Figure 5A:
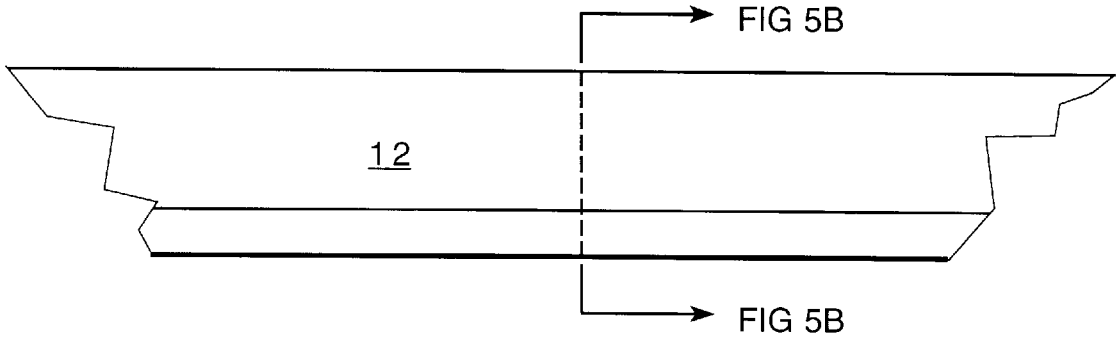
FIG. 5A is a rear detail section of any one of the frame members.
Figure 5B:
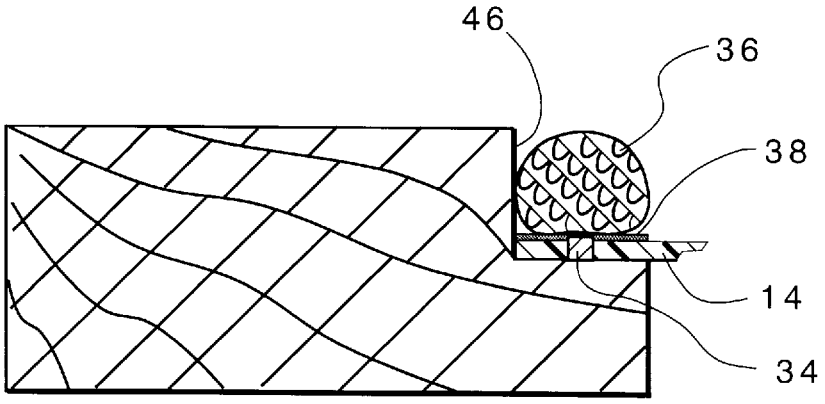
FIG. 5B is a cross section of the frame member taken along the line 5B—5B of FIG. 5A.

Concerning FIG. 5A, a rear typical section of the frame 12 is shown, FIG. 5B shows a cross section of the frame with a lip 46 on which is mounted the mesh 14 secured by staples 34 and glue 36 bonding molding 38 in place.

Figure 6:
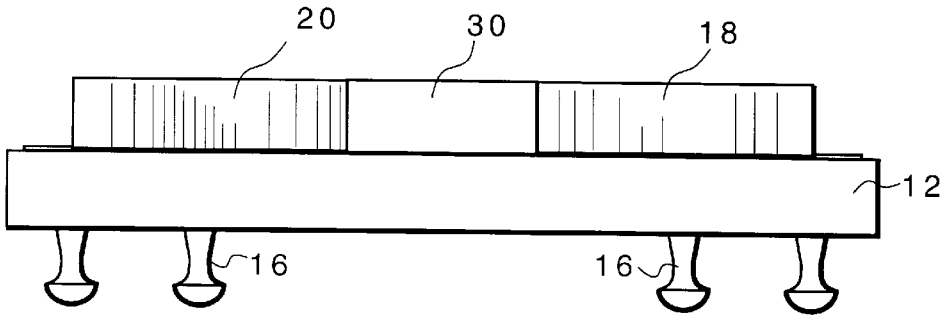
FIG. 6 is a top plan view of the invention.

FIG. 6 shows that legs 18 and 20 as well as the top surface of block 30 lie in the same plane.

Figure 9:
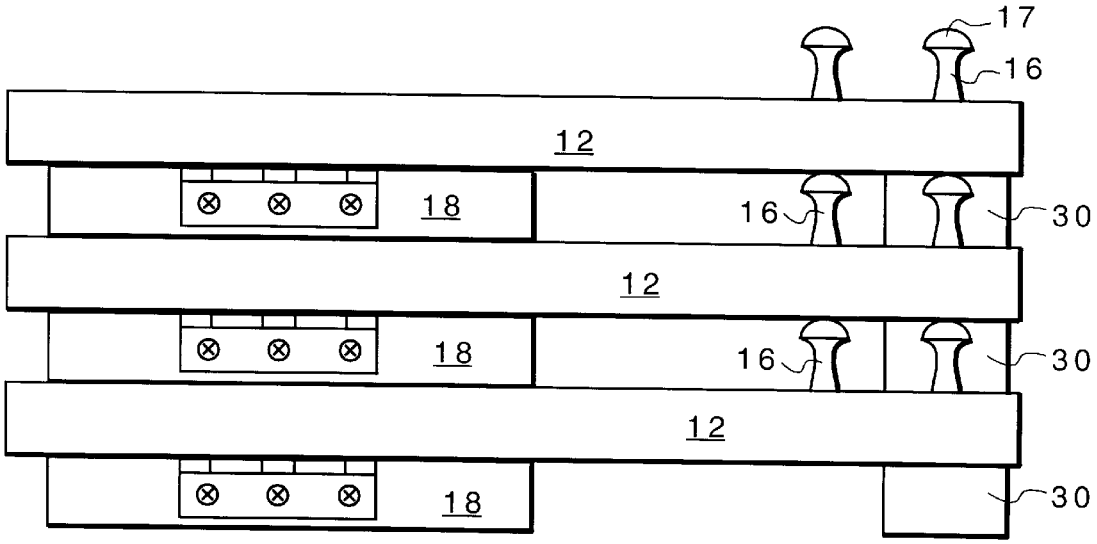
FIG. 9 is side horizontal view of a plurality of the inventions in a stacked mode.
Figure 7:
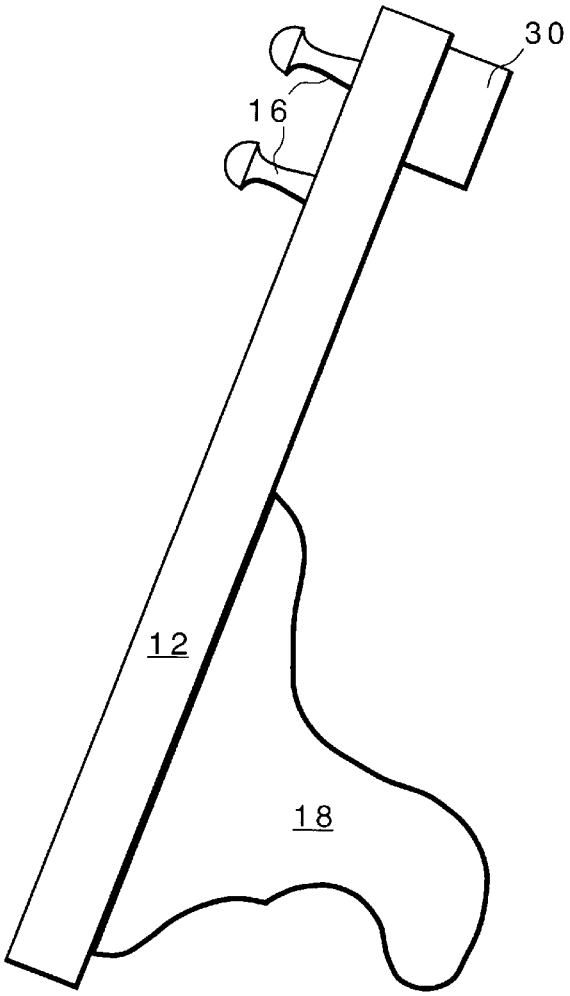
FIG. 7 is a side elevation view if the invention in as standing mode.
Figure 8:
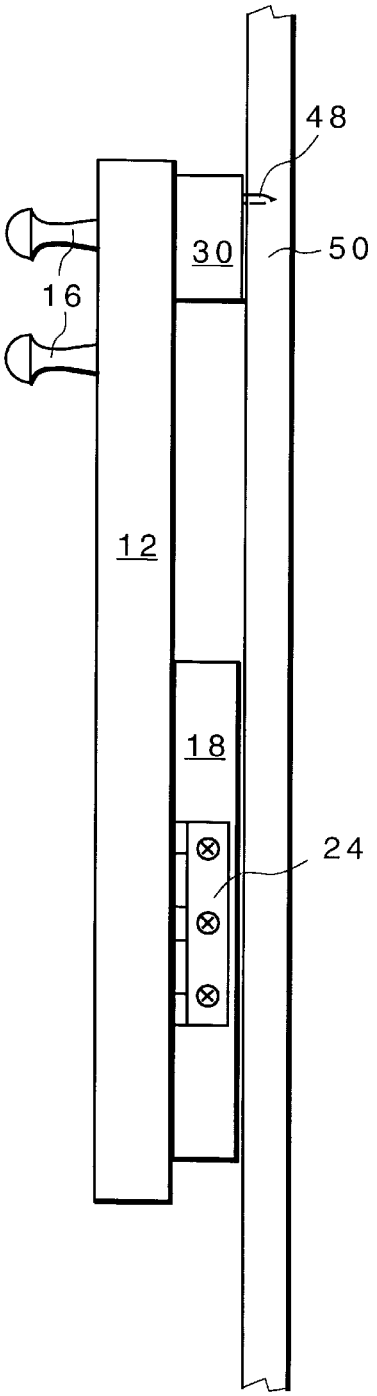
FIG. 8 is a side elevation view of the invention in a hanging mode.

FIGS. 7,8 and 9 illustrate the invention in its different modes, FIG. 7 in the standing mode, FIG. 8 in the hanging mode, held by a fastener 58 to the vertical surface 50. FIG. 9 shows an example of the invention with three frames in the stacked mode, where the top surface 17 of posts 16 act to engage frame 12 in a manner similar to folded legs 18 and block 30 to provide an extremely stable package for storing or transporting with earrings in place.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An apparatus for transporting and displaying jewelry comprising:

a frame, having top and bottom members joined at their opposite ends with side members to define a central open area;

a lip on one face of the frame members extending toward the open central area;

a mesh material affixed to each of said members and occupying the central open area for receiving and securing jewelry having a post or open hook;

a plurality of mushroom shaped dowels extending from a front face of the frame for receiving and securing jewelry of the closed loop variety;

a pair of legs movably attached to the rear face of each side member, and a block, having an inverted keyhole shaped aperture attached to the rear face of the top member.

2. An apparatus for displaying and transporting jewelry according to claim 1 wherein: the mesh material is affixed with staples to a lip formed along the inwardly facing edge of the rear face of the frame.

3. An apparatus for displaying and transporting jewelry according to claim 2 wherein: the area of affixing the mesh material is covered by a molding, glued in place.

4. An apparatus for displaying and transporting jewelry according to claim 3 wherein: the mesh material is formed of a soft plastic.

5. An apparatus for displaying and transporting jewelry according to claim 4 wherein: the legs are attached to the side members by vertically aligned hinges, thereby allowing the legs to move in a horizontal plane.

6. An apparatus for displaying and transporting jewelry according to claim 5 further including: means for locking the legs in an extended position.

7. An apparatus for displaying and transporting jewelry according to claim 6 wherein: the outer most extending surface of the legs in folded position and the said surfaces of the block lie in a common plane.

8. An apparatus for displaying and transporting jewelry according to claim 7 wherein: the mushroom shaped dowels extend from the front face of the frame a distance equal to the distance the common plane is separated from the rear face of the frame.

9. An apparatus for displaying and transporting jewelry according to claim 8 including: two mushroom shaped dowels.

10. An apparatus for displaying and transporting jewelry according to claim 8 including: four mushroom shaped dowels.

* * * * *